United States Patent [19]

Sherrill

[11] 4,138,056

[45] Feb. 6, 1979

[54] MAILBOX SIGNAL

[76] Inventor: James T. Sherrill, Rte. 3, Box 635, Fayetteville, N.C. 27406

[21] Appl. No.: 854,541

[22] Filed: Nov. 25, 1977

[51] Int. Cl.[2] ..... D65D 91/00

[52] U.S. Cl. ..... 232/35

[58] Field of Search ..... 232/35, 34

[56] References Cited

U.S. PATENT DOCUMENTS

| | | | |
|---|---|---|---|
| 2,193,747 | 3/1940 | Thompson | 232/35 |
| 2,433,940 | 1/1948 | Weaver | 232/35 |
| 2,807,410 | 9/1957 | Ward | 232/35 |
| 3,391,861 | 7/1968 | Seckler | 232/35 |
| 3,516,383 | 6/1970 | Goodman | 232/35 X |
| 3,596,631 | 8/1971 | Sutton | 232/35 X |
| 3,866,823 | 2/1975 | Grayson | 232/35 |
| 4,000,847 | 1/1977 | Duis | 232/35 |

*Primary Examiner*—Roy D. Frazier
*Assistant Examiner*—Peter A. Aschenbrenner
*Attorney, Agent, or Firm*—Mills & Coats

[57] ABSTRACT

In abstract, a preferred embodiment of this invention is a signal device in the form of a coil type spring with an elongated end thereon for fitting under the lip of the door of a rural type mailbox when the door is in the closed position. Intermediate the end of the elongated portion is an enlarged portion preferably in the form of a ball to increase the visibility of the device. The end of the coil spring opposite the elongated portion has a provision for securing the same to the side of the standard rural type mailbox.

5 Claims, 4 Drawing Figures

FIG. 1
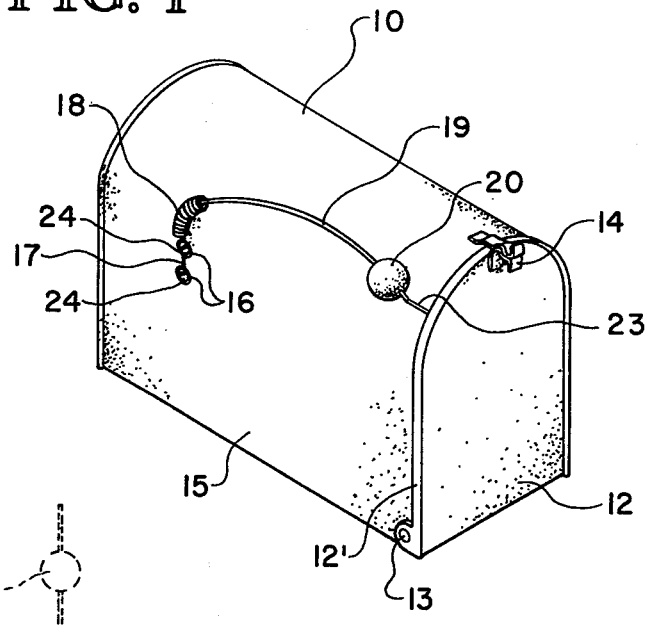
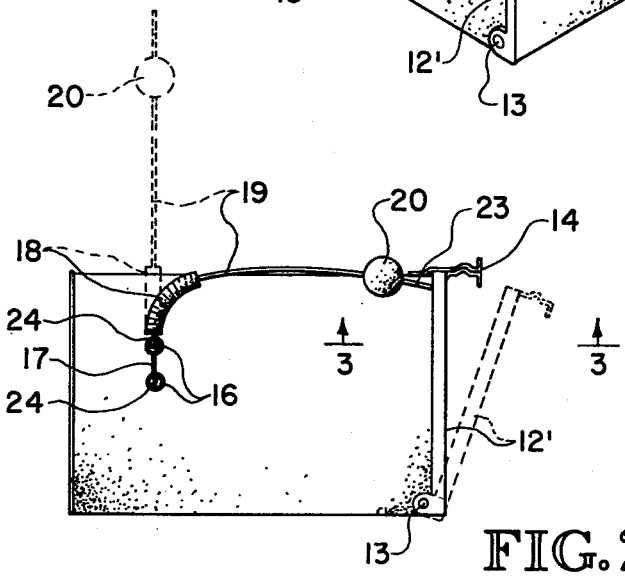
FIG. 2
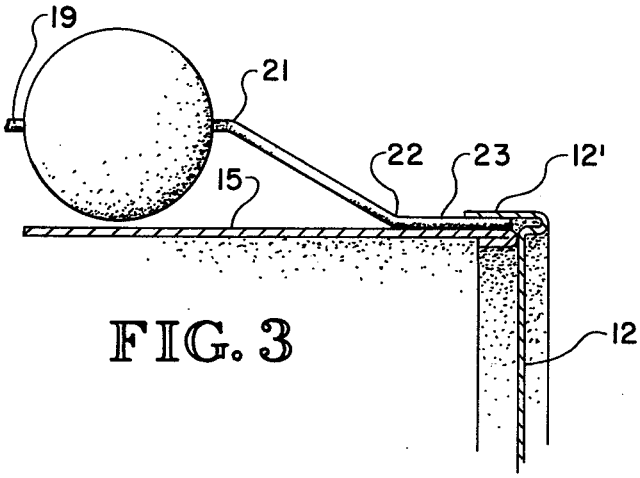
FIG. 3
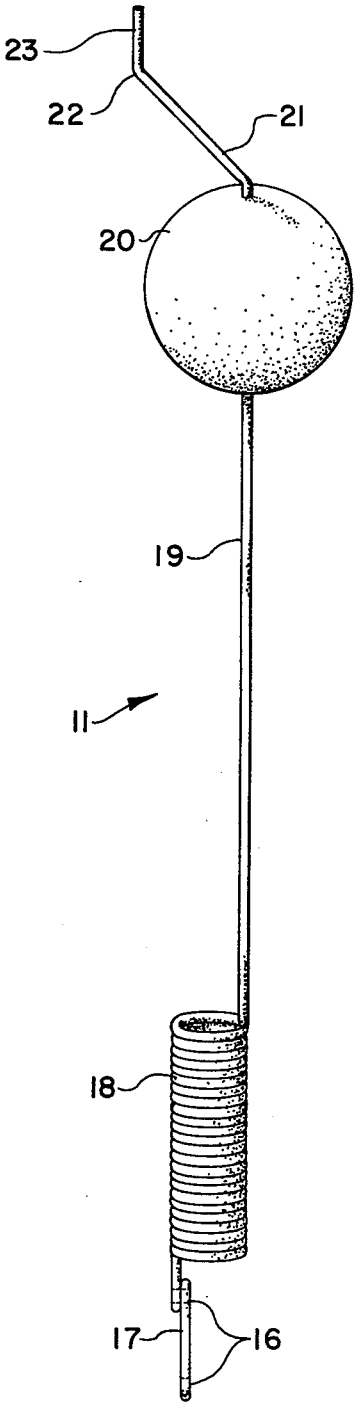
FIG. 4

MAILBOX SIGNAL

This invention relates to indicators and more particularly to devices for signaling when the door of a mailbox has been opened.

BACKGROUND OF THE INVENTION

In the past various types of signaling devices have veen devised for indicating when mail has arrived. These devices have included mechanical linkages hooked to the door of the mailbox, spring biased pivotable signals released by the box door being open as well as bells that jingle when mail is deposited. All of these devices, however, have been relatively complex to manufacture and install and are subject to easily being damaged by bending or otherwise to cause the same to become inoperative. Although devices of this type have been known since the 19th Century and even through rural type mailboxes are now being installed in Cities and suburban communities with many millions in actual use, no practical signal means has ever been marketed with great success and as far as is known none are on the market today.

SUMMARY OF INVENTION

After much research and study into the above-mentioned problems, and after much experimentation with various types of signaling devices, the present invention has been developed to provide an extremely simple and yet highly efficient signaling device for rural type mailboxes which can be installed by anyone through the use of a pair of self-tapping screws. No additional door engaging mechanism is necessary and the signal is highly visible from all directions. Also it will not be confused with the outgoing mail signal flag provided on all postal department approved rural type boxes.

In view of the above, it is an object of the present invention to provide an extremely simple and yet highly efficient signal means for rural type mailboxes.

Another object of the present invention is to provide an inexpensive and yet trouble free mailbox type signal means.

Another object of the present invention is to provide a mailbox type signal means formed from a single piece of spring steel.

A further object of the present invention is to provide a mailbox signal device which is easy to install and does not require accurate measurement location to operate.

Another object of the present invention is to provide a mailbox type signal device which has no mechanical moving parts.

Another object of the present invention is to provide in a mailbox type signal device that can operate properly even after severe use and damage.

Another object of the present invention is to provide a mailbox signal device including a generally spherical shaped indicator which can be seen equally well from all directions.

Other objects and advantages of the present invention will become apparent and obvious from a study of the following description and the accompanying drawings which are merely illustrative of such invention.

BRIEF DESCRIPTION OF DRAWINGS

FIG. 1 is a perspective view of a rural type mailbox having the signal of the present invention installed thereon and being in closed position awaiting delivery of mail;

FIG. 2 is a side elevational view of the box and the signal shown in FIG. 1 with the signal in retained and released positions;

FIG. 3 is a fragmentary sectional view taken through lines 3—3 of FIG. 2; and

FIG. 4 is an enlarged view of the signal device of the present invention.

DETAILED DESCRIPTION OF PREFERRED EMBODIMENT

With further reference to the drawings, a standard rural type mailbox, indicated at 10, has the signal device of the present invention, indicated generally at 11, attached thereto.

The box 10 includes a door 12 which pivotably opens about pins 13. The normal friction latch means 14 is shown.

Referring more specifically to the signal of the present invention, the means for securing the same to the side 15 of box 10 opposite the normal mail flag signal (not shown) is shown in the form of a pair of loops 16. The wire-like tail forming loops 16 is integrally formed into coil spring portion 18. The end of spring 18 opposite loops 16 has a generally straight elongated portion 19 which passes through a ball like signal indicator 20. This signal indicator is preferably of an adequate size to be seen from a distance and can be painted a color that can be readily seen such as international orange.

At the end of elongated portion 19, after it passes through ball indicator 20, is crooked in a pair of obtuse angle bends 21 and 22 to terminate in a tip portion 23 which has a longitudinal axis generally parallel to the axis of elongated portion 19.

Because of the abuse in use that rural type mailboxes encounter, the lip 12' around door 12 always includes a certain amount of play or spacing from the sides of box 10. The tip portion 23 of signal 11 is so sized to be able to readily fit in the loose fitting opening between lip 12' and the side 15 of box 10 without unduly binding such door.

To use the signal device of the present invention, the openings of loops 16 are marked in vertical alignment on the side 15 of box 10 toward the end opposite door 12 and a hole is punched in such side by means such as a nail. A self-tapping metal screw 24 is then passed through each of the loops and screwed into the punched hole in the box. Thus the device of the present invention is vertically secured in place.

Because there will be some variance in the distance from the door at which different people will install the signal, the entire device of the present invention, except for the ball indicator 20, is formed from a single piece of spring steel. Thus if the mounting of screws 24 are placed closer to door 12 the elongated portion 19 can bend or bow and still be able to be inserted into the slot between lip 12 and the side 15 of box 10. On the other hand, if the screws are mounted further toward the back of the box, then when the signal is folded down the bending will generally take place primary in the coil spring area and the elongated portion will remain generally straight.

To use the signal of the present invention, once it has been installed on the box as hereinabove described, the signal is pushed down from the generally vertical position shown in dotted lines in FIG. 2 to the generally horizontal position shown in solid lines therein. The tip portion 23 is then placed between the lip 12' of door 12 and the side 15 of box 10 as shown particularly clear in FIG. 3 and will, of course, be retained there. When the mailman delivers mail to the box, he will open door 12 against the retention of friction latch 14 and the signal 11 of the present invention will be released and will pop up to the position shown in dotted lines in FIG. 2. It will remain in such position until the owner of the box looks out of his window or otherwise views the fact that the door of his mailbox has been opened, removes the mail thereform, and resets the signal to the position shown in FIG. 1.

Because the loop portion 17 comes off one side of coil spring 18 and elongated portion 19 comes off the opposite side, coupled with the disposition of the obtuse angle bends 21 and 22, both the spring portion 18 and the ball indicator 20 are offset from box 10 and will not rub thereagainst when in the down position nor during springing up to the signal position. This saves wear and tear on both the box and the signal and should such signal be removed for any reason, only the two small holes left by screws 24 would give any evidence of the signal having been installed thereon.

From the above, it can be seen that the present invention has the advantage of providing an extremely simple and yet highly efficient signal means for mailboxes. Not only is the inexpensiveness in production and thus ultimate consumer cost extremely low but the same can be installed using the simplest of tools, i.e., hammer and nail to start the self-tapping screws and a screw driver to drive the same home. There is no wear and tear on the box or the signal as the same operates so the same should last indefinitely. Since there are no mechanical linkages or other moving parts, the signal of the present invention will remain operative regardless of almost any abuse that can be given the same.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended Claims are intended to be embraced therein.

What is claimed is:

1. A signal for attachment to a rural type mailbox to signal when the door of the box has been opened comprising: a signal constructed from a single wire-like piece of material and including means for securing one end of said signal to the side of said mailbox in a generally vertical position; a coil type spring formed adjacent said end of said signal secured to said box; an elongated portion disposed from said spring portion from the end thereof opposite said end secured to said box; an enlarged, generally spherically shaped indicator mounted on said elongated portion adjacent the end thereof opposite said coil spring portion; and a tip end of said signal on the side of said enlarged indicator opposite said elongated portion in the form of a pair of obtuse angle bends in said wire-like material terminating in a tip portion whose longitudinal axis is generally parallel to the longitudinal axis of said elongated portion, said tip portion being adapted to be releasably retained between said door and said box when said door is closed and said signal is bent to a generally horizontal position whereby said tip portion will be released when said door is opened thereby allowing said signal to biasly spring upright to give an indication of mail delivery.

2. The signal of claim 1 wherein loops are formed in the end of said signal attached to said box thereby allowing said securing means to be passed therethrough.

3. The signal of claim 2 wherein said securing means are self-tapping type screws.

4. The signal of claim 1 wherein said single wire-like piece of material is formed from spring steel.

5. The signal of claim 1 wherein the distance between the longitudinal axes of said tip portion and said elongated portion is approximately equal to the radius of said generally spherical shaped indicator.

* * * * *